United States Patent [19]

Williams

[11] Patent Number: 4,485,984

[45] Date of Patent: Dec. 4, 1984

[54] PILE FABRIC CREEL HAVING FOLD-UP END ASSEMBLIES

[76] Inventor: Clarence O. Williams, 3617 Sheffield Dr., Rocky Mount, N.C. 27801

[21] Appl. No.: 459,453

[22] Filed: Jan. 19, 1983

[51] Int. Cl.[3] ..... B65H 75/02; B65D 85/671

[52] U.S. Cl. ..... 242/77.1; 242/62; 206/395

[58] Field of Search ..... 242/77.1, 62; 206/395, 206/398, 408, 415, 416

[56] References Cited

U.S. PATENT DOCUMENTS

| | | | |
|---|---|---|---|
| 2,976,987 | 3/1961 | Kessler | 206/408 |
| 3,001,641 | 9/1961 | Kessler | 242/77.1 X |
| 3,944,157 | 3/1976 | Kessler | 242/77.1 |
| 3,989,203 | 11/1976 | Williams | 242/62 X |
| 4,044,966 | 8/1977 | Schneider | 242/77.1 |

*Primary Examiner*—Stuart S. Levy
*Assistant Examiner*—Katherine Jaekel
*Attorney, Agent, or Firm*—B. B. Olive

[57] ABSTRACT

An improved creel useful for reeling and storing materials such as pile fabrics is formed from two spaced end assemblies connected by a tubular member. Each end assembly comprises a high-strength, relatively-flat, box-like structure which is folded from a prescored cardboard blank. Suitable hook strips are fixedly secured to the end assemblies to receive the convolutions of material. The box-like structure is also adapted to other applications utilizing strips without hooks.

5 Claims, 19 Drawing Figures

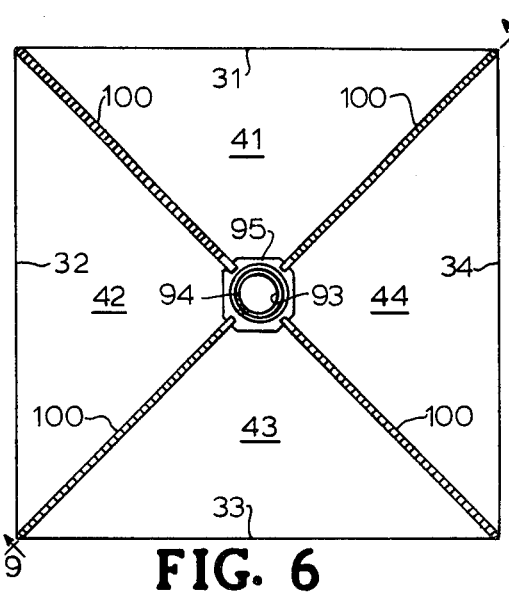
FIG. 6
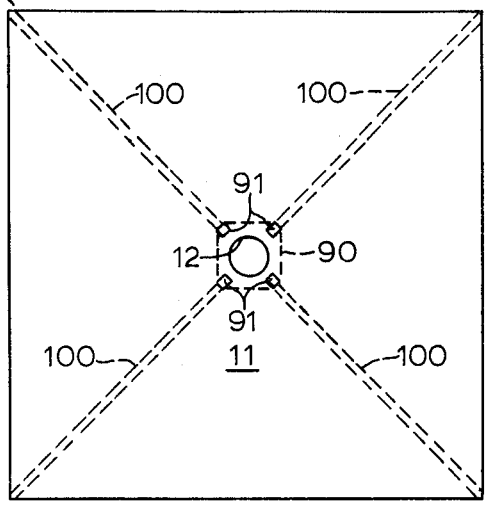
FIG. 7
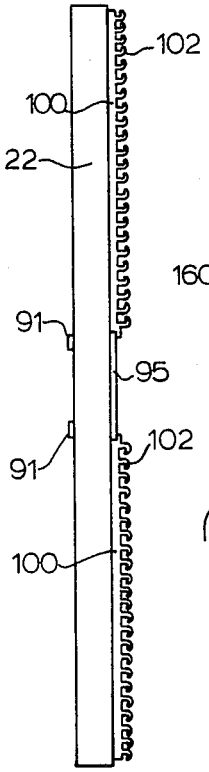
FIG. 8
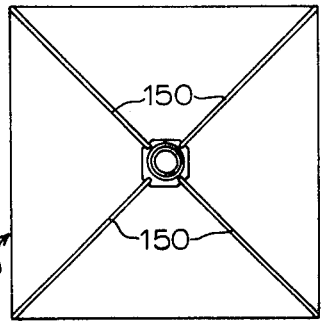
FIG. 18
FIG. 17
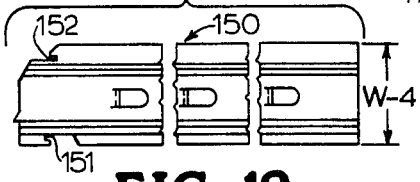
FIG. 19
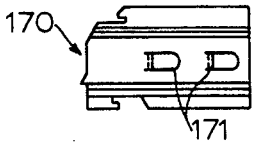
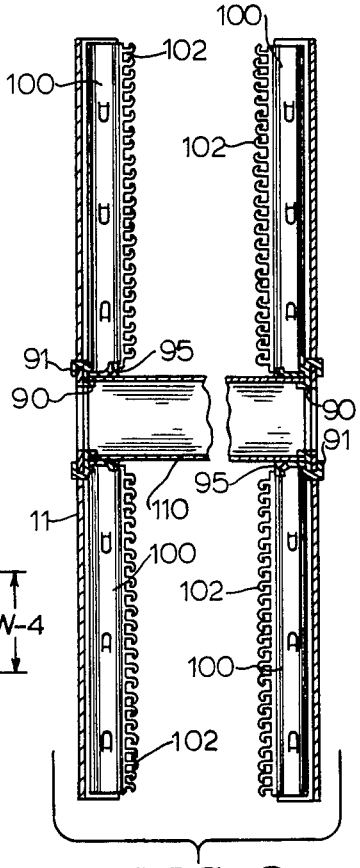
FIG. 9

PILE FABRIC CREEL HAVING FOLD-UP END ASSEMBLIES

DESCRIPTION

1. Technical Field

This invention relates generally to creels for storing and shipping pile fabrics, and the like. More specifically, the invention relates to an improved end piece construction for such a creel.

2. Background Art

The history of the prior art shows that the end construction for pile fabric creels usually takes the form of radially-extending hook strips which are held in place and stengthened at their point of intersection. U.S. Pat. Nos. 3,189,172 and 2,976,987 show this general construction. Additional strength can be added to such a construction by the use of cross bars to join the ends of the hook strips as shown in U.S. Pat. Nos. 3,347,484 and 3,593,847.

The above-mentioned all-metal constructions require riveting or welding of numerous parts. The shipping of such products takes up a great deal of space even if the end frames can be shipped partially disassembed such as the frame in U.S. Pat. No. 2,976,987. Even though the expense of the materials, shipping, and assembly of the all-metal creels of the prior art is considerable, the creels generally are discarded after one use.

U.S. Pat. No. 4,044,966 is illustrative of a frame for pile fabric formed from a pair of substantially solid plastic members with hook bands of metal disposed in guideways therein. Such a frame provides rigidity but lacks the desired qualities needed for shipping of the frames.

Thus, in this highly competitive market, there has developed an acute need for an end assembly which can be economically produced from inexpensive materials, shipped in a minimum space, easily assembled and which is at least partially reusable.

U.S. Pat. No. 3,989,203, issued to the applicant of the present invention, illustrates an improved creel which utilizes two end assemblies held in opposed space relation by a tubular spreader arm. Each end assembly comprises a structural frame formed from a blank of scored, corrugated paperboard which is folded into an extremely strong unit of rectangular cross section and to which is attached along the diagonals thereof four metal hook strips stamped from metal.

The creel frame described in U.S. Pat. No. 3,989,203 has been widely applied and has provided a dramatic improvement in many respects. However, after extensive application, certain disadvantages have been recognized. For example, the creel of U.S. Pat. No. 3,989,203 requires the hook strips to be installed after the folding operation whereas it would be desirable to install the teeth strips on the flat blank before folding and so as to be able to ship the blanks folded flat with the teeth strips already applied. Another disadvantage has been the need to use taping over the seams and folds during the final assembly operation. A further and significant disadvantage has been that the folded frame members of the type described in U.S. Pat. No. 3,989,203 are sometimes forced outwardly when heavily loaded and it would be advantageous to avoid this distortion of the frame members in service.

Thus, the principal object of the present invention is to improve the pile fabric creel taught by applicant's prior U.S. Pat. No. 3,989,203. More specifically, it is the object of the present invention to achieve a more rigid frame, to provide a frame construction which enables the teeth strips to be secured to the flat, unfolded frame, and shipped flat with the teeth strips preinstalled so as to avoid the need for installing the teeth strips at the point of use. Another object is to provide an improved pile fabric creel which does not require taping of the fold seams as shown in U.S. Pat. No. 3,989,203. The foregoing and other objects will become apparent as the description proceeds.

DISCLOSURE OF THE INVENTION

According to the present invention, the creel has two end assemblies held in opposed spaced relation by a tubular spreader arm, with each end assembly comprising a structural frame formed from a blank of scored, corrugated paperboard which is folded into an extremely strong, substantially rigid unit of rectangular cross section and to which are attached four metal hook strips made from rigid stamped metal.

More specifically, the blank includes a square, central back panel and four elongated rectangular side panels which are hingedly connected along score lines to the back panel. Four triangular front panels are hingedly connected to the side panels. The front panels are folded inwardly and parallel to the back panel during final assembly. Prior to folding, the hook strips are attached to selected closure flaps by inserting formed tabs on the hook strips into slits in the selected closure flaps after which the tabs are bent against the closure flaps which secure the strips in place. The hook strips rest flat against the closure flaps of the structural frame when unfolded and extend radially from the center of the frame when the panel is folded for use. The respective planes of the generally-flat hook strips are positioned perpendicular to the plane of the front panel when the panel is folded for use and the hook strips, in conjunction with the closure flaps on which they are mounted, serve as internal reenforced, substantial rigid, structural runners.

A centrally-located, back plate member is secured to the back panel and in conjunction with a centrally located front plate member serves to lock the hook strips and folded panels together when assembled for use. The hook strips are formed with notches which releasably engage the plate members. For use as a creeling frame, the structural frame of the invention has a hole in the center for frictionally receiving and holding a conventional tube-type spreader arm between a pair of the end assemblies.

DESCRIPTION OF THE DRAWINGS

FIG. 4 is a pictorial front view of the blank showing how the blank is folded along its score lines to form the structural frame.

FIG. 5 is a view similar to that of FIG. 4 but with the inner ends of the hook strips secured to the bottom plate with the hooks extending outward.

FIG. 6 is a plan view of the front, inside surface of the folded and secured structural frame.

FIG. 7 is a plan view of the back, outside surface of the folded and secured structural frame.

FIG. 8 is a side elevation view of the folded and secured structural frame.

FIG. 9 is a section view of one folded frame member taken substantially along line 9—9 of FIG. 6 and shown connected through a spreader arm to another frame member shown in a similar section view.

FIG. 17 is a fragmentary plan view of an alternative strip without hooks.

FIG. 18 is a plan view similar to FIG. 6 but using the strips of FIG. 17.

FIG. 19 illustrates a further alternative strip member of shorter length and without hooks.

BEST MODE FOR CARRYING OUT THE INVENTION

Figure 1:
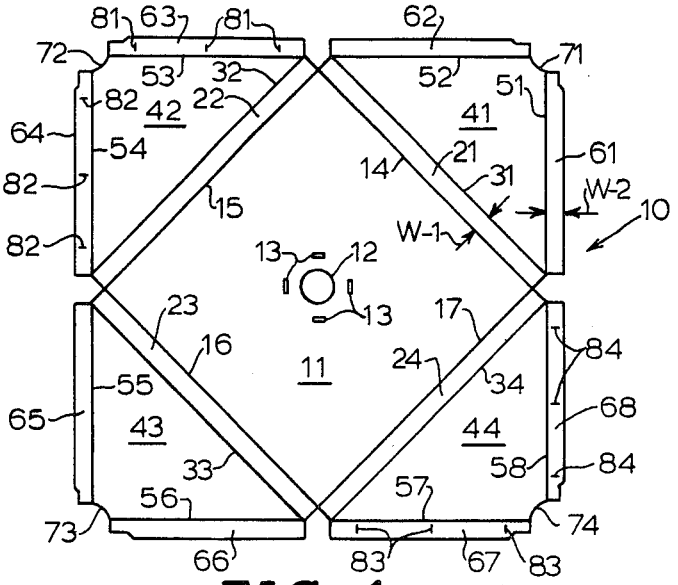
FIG. 1 is a plan view of the blank of material from which the structural frame is made by folding along the score lines shown.

Referring to FIG. 1, blank 10 is a flat, die-cut layout of scored corrugates paperboard. A central, square, back wall panel 11 has a hole 12 cut in its center and slots 13 also cut therein. Back panel 11 is hingedly connected at score lines 14–17 to four elongated, rectangular side wall panels 21–24 of width W-1 (FIG. 1). The side wall panels are in turn hingedly connected at score lines 31–34 to four front wall panels 41–44 which are shaped like isosceles right triangles. Score lines 51–58 hingedly connect eight closure flaps 61–68 of width W-2 to the equal sides of the triangular-shaped front panels 41–44. Small arc-shaped portions 71–74 of each triangle are cut away at the outer right angle corners so that when blank 10 is folded a hole is formed centrally of front panels 41–44 and which lines up with hole 12. Selected ones of the mentioned closure flaps, i.e., flaps 63, 64, 67 and 68, have slots 81–84 respectively cut therein at predetermined locations for mounting the hook strips 100 as later described.

Figure 2:
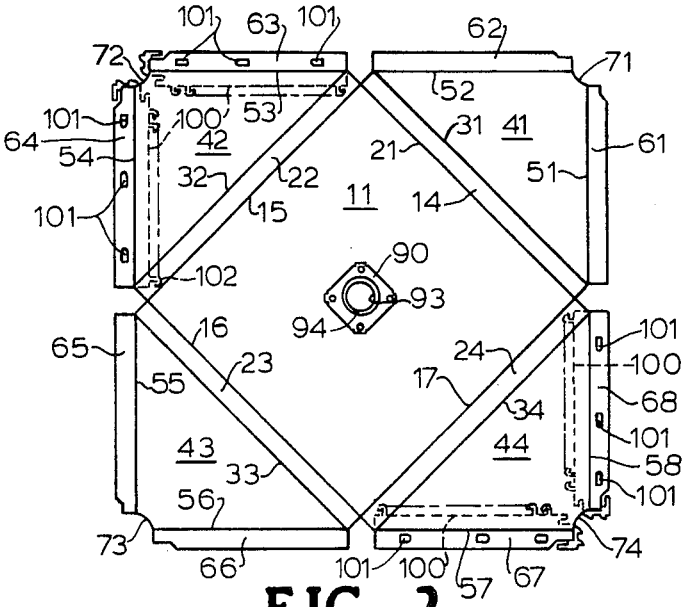
FIG. 2 is a front plan view of the blank showing the hook strips and bottom plate integrally secured to the blank.
Figure 3:
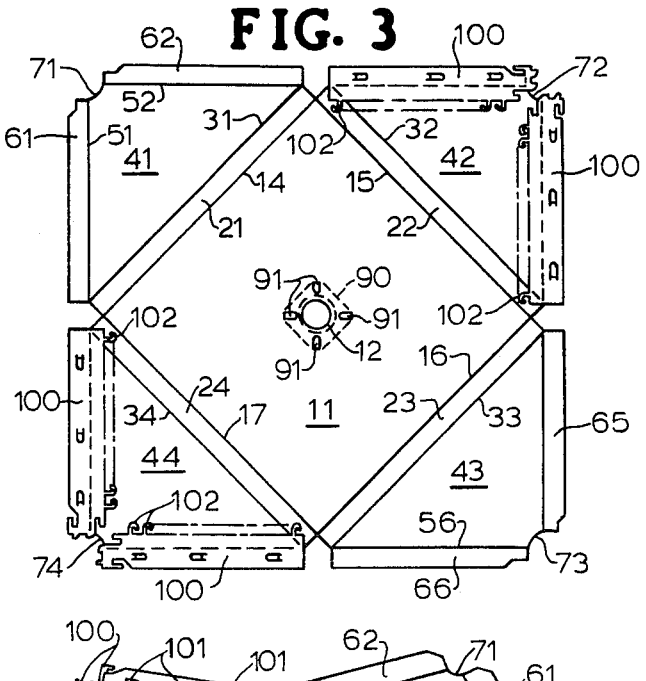
FIG. 3 is a back plan view of the blank of FIG. 2.

Referring particularly to FIGS. 2 and 3, prior to the folding operation, bottom plate 90 and hook strips 100 are integrally secured to blank 10 so that plate 90, strips 100, and blank 10 form a relatively flat unit for unassembled shipping purposes. This is particularly significant since it means that large numbers of the unfolded frames can be shipped flat with the hook strips 100 and bottom plate 90 already flat with the hook strips 100 and bottom plate 90 already installed.

Figure 10:
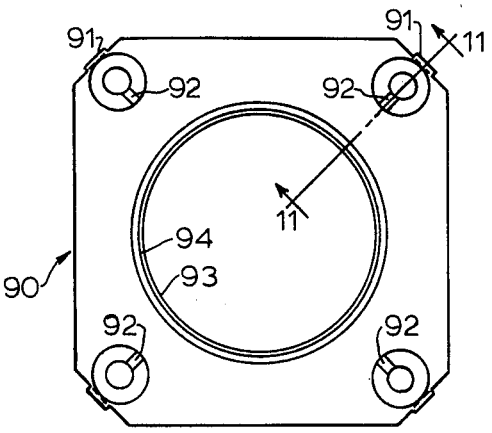
FIG. 10 is a plan view of the bottom plate employed in the present invention.
Figure 12:
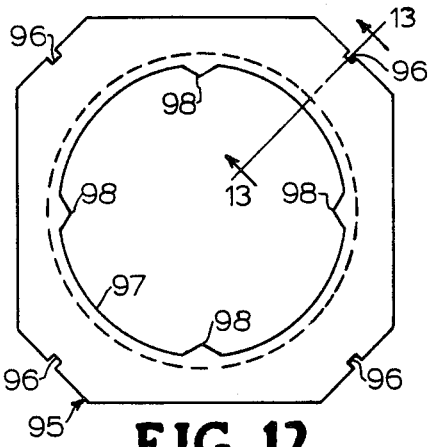
FIG. 12 is a plan view of the top plate employed in the present invention.
Figure 11:
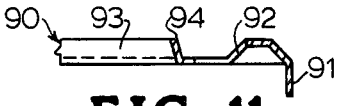
FIG. 11 is a fragmentary section view taken substantially along line 11—11 of FIG. 10.
Figure 13:
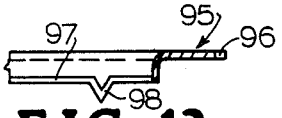
FIG. 13 is a fragmentary section view taken substantially along line 13—13 of FIG. 12.

Bottom plate 90, see FIGS. 10 and 11, has tabs 91 formed integral therewith and which are designed to pass through slots 13 in back panel 11 from the inside. Tabs 91 are then bent and flattened against the outside surface of back panel 11, see FIGS. 3, 7 and 9, so that they retain bottom plate 90 in place on back wall panel 11. Plate 90 also has a hole 93 with an inwardly turned ledge 94 which aligns with hole 12 in plate 11.

Figure 14:
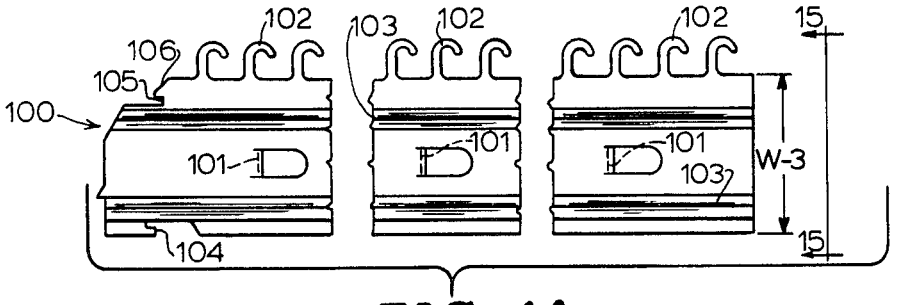
FIG. 14 is a fragmentary plan view of one of the four hook strips employed in the present invention.
Figure 15:
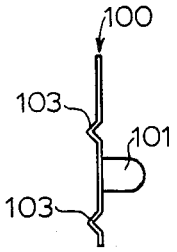
FIG. 15 is an end elevation view taken in the direction of line 15—15 of FIG. 14.

Hook strips 100, see FIGS. 14 and 15, are formed with integral tabs 101 which are designed to pass through slots 81–84 in closure flaps 63, 64, 67 and 68, respectively, and are also formed with hooks 102 and reenforcement ribs 103. As seen in FIG. 2, hook strips 100 are mounted on the outside surfaces of closure flaps 63, 64, 67 and 68 with tabs 101 passing through the respective slots 81–84. The width W-3 (FIG. 14) of the hook strips 100 exceeds the width W-2 of the closure flaps. Once the hook strips are secured, it can be seen that the closure flaps to which they are attached are greatly reenforced and when the frame unit is folded act as reenforced structural runners. Tabs 101 are bent back and flattened against the front surfaces of flaps 63, 64, 67 and 68 which secures the respective strips 100 in place. After hook strips 100 are secured to flaps 63, 64, 67 and 68 and bottom plate 90 is secured to back wall panel 11, the unfolded unit, as previously mentioned, is particularly suited to being shipped in a flat condition to the point of use at which the folding and final assembly operation can be performed as next described.

Referring to FIGS. 4 and 5, front panels 41–44 are raised so that a crease is made along score lines 14–17. As seen in FIG. 4, front panels 42 and 44 are moved further inward and side panels 22, 24 are folded upward with a crease being formed along score lines 32, 34. As further illustrated in FIG. 5, front panels 42, 44 are folded completely inward and closure flaps 63, 64, 67 and 68 are also folded inward against rear wall panel 11 so that the hook strips 100 are positioned with the hooks 102 extending outwardly and with the plane of the substantially-flat hook strips being effectively perpendicular to the plane of the back panel 11. Ledges 104 of strips 100 hook into slots 92 of back plate 90, see FIG. 16, and retain hook strips 100 and front wall panels 42, 44 in place as seen in FIG. 5. At this stage, hook strips 100 and hooks 102 extend radially from the center of panel 11 outwardly to the outer corners of panels 42, 44. Next, as seen in FIG. 5, panels 41 and 43 are folded inward by the same procedure and closure flaps 61, 62, 65 and 66 are also folded inward so that they are positioned against hook strips 100 after which top plate 95 is installed to complete the securement.

Figure 16:
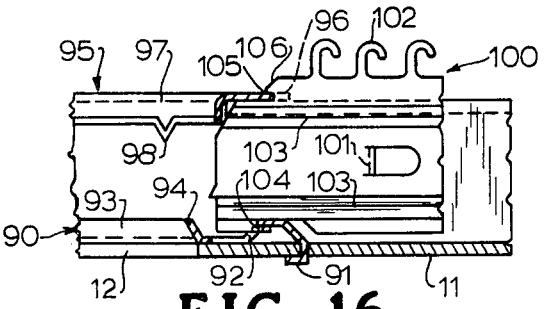
FIG. 16 is a fragmentary section view illustrating the assembly of the bottom plate, hook strip and top plate as a unit.

FIG. 6 is illustrative of what the inside or front side of the assembled frame looks like when all folding operations are completed and after top plate 95 has been installed and snapped into place as seen in FIG. 16. Top plate 95 has slots 96 formed therein which mate in a locking relationship with ledges 105 on the inner positioned ends of hook strips 100. Ledges 105 are tapered as at 106 so that top plate 95 can slide downwardly thereon and snap into place in slots 96 thus retaining plates 90, 95 and hook strips 100 in a releasably locked relation. Top plate 95 has a hole 97 which aligns with hole 12 in panel 11. Barbs 98 protrude from the side of hole 97. The structural frame is now completely assembled and ready for use.

For creel application, it is to be understood that a pair of such structural frames are necessary along with a conventional tube-type spreader arm 110 as shown in FIG. 9. Tube 110 is inserted into one of the structural frames so that the outer end of tube 110 fits over ledge 94 of bottom plate 90 while passing through hole 97 of top plate 95. Barbs 98 of top plate 95 dig into tube 110 to firmly secure tube 110 once pressed onto ledge 94 and through hole 97. A similar operation is performed on the opposite end of tube 110 by inserting it into another similar structural frame.

As compared to applicant's creel assembly disclosed in U.S. Pat. No. 3,989,203, these significant advantages have been realized:

(a) It now becomes possible to install the hook strips and back plate on the panel and ship large numbers of panels folded flat with the hook strips and back plate already installed.

(b) At the user's location, the hook strip installing step has been eliminated and assembly has been reduced to the step of folding the front panels into place and snapping the front plate into its securing position.

(c) Taping of the folded seams after the folding operation has been eliminated.

(d) In use, after the spreader arm has been installed and the improved creel frame loaded, the tendency of the end pieces to bow inward has been eliminated or otherwise reduced to acceptable limits with extremely heavy loads.

(e) The hook strips, in conjunction with the closure flaps on which they are mounted, provide substantially increased structural runners as compared to the closure flaps acting alone as structural runners.

(f) Since the folded frame of the invention can be unfolded simply by unsnapping the top plate, a reusable, creel frame is provided.

The invention recognizes that some types of fabric are simply rolled on a tube between two end flanges. Thus, FIG. 17 illustrates use of modified metal strips 150 which can be employed without teeth and folded into an assembled structural unit 160 as seen in FIG. 18 for use in more general applications. Strips 150 are formed at their inner ends with appropriate ledges 151 to engage the slots 92 of back plate 90 and with ledges 152 to engage top plate 95. Strips 150 have a width W-4 which mates the width W-2 of the closure flaps and thus reenforces the closure flaps and in conjunction with the closure flaps act as reenforced runners within the fully-folded and assembly frame unit.

It is also recognized that four of the strips 150 without teeth could be secured to those closure flaps shown in FIG. 2 to which the strips 100 with teeth are not secured so as to provide even greater strength in the structural runners formed by the closure flaps.

Additionally, where the folded structural member is not used for pile fabric or exposed to heavy loads, a relatively short-locking strip can be attached to selected closure flaps such as strip 170 with a pair of tabs 171 as seen in FIG. 19.

In all embodiments, it will also be noted that the width W-1 of the side walls in conjunction with the width W-2 of the closure flaps effectively establish the thickness of the folded structural member. Both peripheral and radial strength are thus provided.

Thus, in summary, a substantially improved and unique structural member has been provided, useful particularly for pile fabric creel applications but also useful in other applications where the hook type strips are not required.

What is claimed is:

1. A structural member adapted for being formed from folded sheet material and for service as an end member for a pile fabric creel or in similar applications where box-like support structures are required, comprising in combination:

(a) a blank construction of foldable sheet material having score lines arranged for folding the blank into a structural member, comprising:

(i) a central, substantially square, back wall panel having an inner and an outer side;

(ii) four substantially rectangular side wall panels, each being hingedly connected on a score line along one of its longer sides to a corresponding edge of the back wall panel, and having a width approximately equal to the thickness of the structural member when folded;

(iii) four front wall panels, one of which is hingedly connected on a score line to each of said side wall panels, said front wall panels being substantially isosceles right triangles with the hypotenuse thereof forming the hinged connection with the side wall panels; and (iv) a plurality of substantially rectangular closure flaps, each having an inner and an outer side connected on score lines to the equilateral sides of said front wall panels and having a width approximately equal to the thickness of the structural member when folded; and (b) a set of substantially flat, rigid, metal strips, and means for securing each said strip rigidly against and in mating lengthwise direction to the outer side of a selected said closure flap so as to reenforce such selected flap and having upper and lower locking formations on one end thereof proximate the right angle corner of the said front wall panel to which said selected said closure flap is connected and on which said strip is secured;

(c) first plate means centrally secured on the inner side of said back wall panel and formed so as to be releasably engagable with each said strip lower locking formation when mated therewith; and (d) second plate means formed so as to be releasably engagable with each said strip upper locking formation when mated therewith, (e) said means for securing each said strip comprising a plurality of fastening means, said fastening means being spaced lengthwise of each said strip, extending through the selected closure flap to which the strip is secured, and having a portion thereof lying in a plane parallel to the plane of the strip which it secures and in contact with the inner side of the selected closure flap to which the strip is secured, whereby when said blank construction is folded along each of said score lines into a structural, box-like member of rectangular cross section, inner structural runners along the diagonals thereof are formed by said closure flaps reenforced by said metal strips and said first and second plate means adapt to being releasably engaged with the respective upper and lower locking formations of said strips whereby to maintain the integrity of said structural member after folding.

2. In a structural member as claimed in claim 1 wherein said metal strips comprise hook strips having hooks extending outwardly from said front wall panels after folding of said sheet material for receiving convolutions of pile fabric, and the like, and extending for the length of the selected said closure flaps on which said strips are mounted.

3. In a structural member as claimed in claim 2 wherein said hook strips assume a radial arrangement after folding of said sheet material with the inner ends thereof having said upper and lower locking formations formed by notches for releasably engaging mating formations on said first and second plate means.

4. In a structural member as claimed in claim 1 wherein said structural member in said folded form includes a central opening extending through said front and second plate means and said front and back panels and including a spreader arm adapted to be secured in said first and second metal plate means.

5. A structural member adapted for being formed from folded sheet material and for service as a box-like support structure, comprising in combination;

(a) a blank construction of foldable sheet material having score lines arranged for folding the blank into a structural member, comprising:

(i) a central, substantially square, back wall panel;

(ii) four substantially rectangular side wall panels, each being hingedly connected on a score line along one of its longer sides to a corresponding edge of the back wall panel, and having a width approximately equal to the thickness of the structural member when folded;

(iii) four front wall panels, one of which is hingedly connected on a score line to each of said side wall panels, said front wall panels being substantially isosceles right triangles with the hypotenuse thereof forming the hinged connection with the side wall panels; and (iv) a plurality of substantially rectangular closure flaps, each having an inner and an outer side, connected on score lines to the equilateral sides of said front wall panels and having a width approximately equal to the thickness of the structural member when folded; and (b) a set of substantially flat, rigid, metal strips, and means for securing each said strip against the outer side of a selected closure flap so as to reenforce such selected flap and having one end thereof located proximate the right angle corner of the said said front wall panel to which said selected said closure flap is connected and on which said strip is secured; and (c) securing means having one portion thereof secured to said back wall panel and another cooperative portion adapted to engage each said one end of said strip to secure each said strip against said back panel and to retain said sheet member after folding in the folded condition, (d) said means for securing each said strip comprising a plurality of fastening means, said fastening means being spaced lengthwise of each said strip, extending through the selected closure flap to which the strip is secured, and having a portion thereof lying in a plane parallel to the plane of the strip which it secures and in contact with the inner side of the selected closure flap to which the strip is secured, whereby when said blank construction is folded along each of said score lines into a structural, box-like member of rectangular cross section, inner structural runners along the diagonals thereof are formed by said closure flaps reenforced by said metal strips and said securing means adapt to engage and secure said strips to said back panel whereby to maintain the integrity of said structural member after folding.

* * * * *